United States Patent [19]

Nakamura

[11] Patent Number: 5,050,858

[45] Date of Patent: Sep. 24, 1991

[54] SHEET FEED CONTROL METHOD

[75] Inventor: Tadashi Nakamura, Morioka, Japan

[73] Assignee: Alps Electric Co., Ltd., Tokyo, Japan

[21] Appl. No.: 447,968

[22] Filed: Dec. 8, 1989

[30] Foreign Application Priority Data

Jan. 9, 1989 [JP] Japan ..... 1-2285

[51] Int. Cl.[5] ..... B65H 7/02

[52] U.S. Cl. ..... 271/265; 271/266; 400/320; 226/8; 226/45; 226/168

[58] Field of Search ..... 271/110, 111, 227, 258, 271/259, 265, 266; 400/624, 320; 354/5; 226/8, 32, 45, 168

[56] References Cited

U.S. PATENT DOCUMENTS

| | | | |
|---|---|---|---|
| 3,741,357 | 6/1973 | Krysiuk et al. | 271/227 |
| 4,015,523 | 4/1977 | Evans et al. | 271/110 |
| 4,729,557 | 3/1988 | Kiyohara . | |
| 4,734,868 | 3/1988 | Delacy | 400/320 |

FOREIGN PATENT DOCUMENTS

| | | | |
|---|---|---|---|
| 0199376 | 10/1986 | United Kingdom | 400/624 |

*Primary Examiner*—H. Grant Skaggs

*Attorney, Agent, or Firm*—Guy W. Shoup; B. Noel Kivlin

[57] ABSTRACT

There is provided a sheet feed control method for feeding sheets at a predetermined pitch to the printing section of a printing machine that comprises a sheet feeding roller and a pair of small rollers provided one upstream and the other down stream and pressed against the outer periphery of said sheet feeding roller to sequentially catch and convey sheets, said sheet feed roller being rotated by means of a transmission gear mechanism driven by a source of driving force, said control method being characterized by that it is so designed as to be capable of calculating the time when the rear edge of a sheet passes between said sheet feed roller and said upstream small roller and offsetting or compensating for the preceding backlash of said transmission gear mechanism by modifying said pitch when the rear edge of said sheet passes between said sheet feed roller and said upstream small roller by an amount that corresponds to the amount of the backlash. A sheet feed control method according to the present invention can be effectively used for preventing any unintended blanks and overlaps of printing from occurring and ensuring an excellent quality of printing.

3 Claims, 2 Drawing Sheets

SHEET FEED CONTROL METHOD

BACKGROUND OF THE INVENTION (1) Field of the Invention

The present invention relates to a sheet feed control method, and particularly to a sheet feed control method which is excellent in sheet feed accuracy.

(2) Prior Art

Generally, apparatuses, for example, such as a facsimile, a printer, a video printer or the like for outputting various information often are of the type for outputting information to a sheet. Such an output apparatus is provided with a sheet feed mechanism for feeding a sheet which is a medium for outputting information.

In this sheet feed mechanism, there are various types according to uses or the like. In any of them, it is necessary to feed a sheet a predetermined pitch with high accuracy.

Particularly recently, there has been proposed a thermal printer in which a heat generating element is formed to have a length for plural lines in order to increase the effective printing speed thereof, so that printing for plural lines are simultaneously carried out by a single reciprocation of a carriage.

In such a thermal printer as described above, normally, the sizes of characters to be printed, pitches between lines and the like are constant, and therefore, sheet feed is carried out by the same distance as a height of a heat generating element of a thermal head. Accordingly, characters in a line are printed by two reciprocations of the carriage depending on the sizes of printing characters, and therefore, it has been required to effect sheet feed with a sheet feed pitch always set to be constant and with extremely high accuracy.

FIG. 5 shows a conventional sheet feed mechanism. A metal center shaft 2 extends through a center of a cylindrical sheet feed roller 1 formed of resilient material such as rubber, and a stepping motor not shown is connected through a gear transmission mechanism to one end of the center shaft 2. When the stepping motor is driven, the sheet feed roller 1 is rotated and driven a predetermined amount. A small roller 3 at upstream pressed against the outer peripheral surface of the sheet feed roller 1 and a small roller 4 at downstream are rotatably arranged below the sheet feed roller 1.

In the aforementioned conventional sheet feed mechanism, a sheet 5 is inserted between the lower side of the sheet feed roller 1 and the small rollers 3 and 4, and the stepping motor is driven according to a predetermined drive signal whereby the sheet feed roller 1 is rotated at a predetermined angle to feed the sheet 5 held between the sheet feed roller 1 and the small rollers 3 and 4 by a predetermined sheet feed pitch in a printing direction.

However, in the aforesaid conventional sheet feed mechanism, where the sheet 5 is conveyed by the sheet feed roller 1 and the small rollers 3 and 4, at a moment when the rear end of the sheet 5 passes between the sheet feed roller 1 and the upstream small roller 3, the small roller 3 exerts a force in a direction of extruding the sheet and the sheet feed roller 1 becomes rotated early through a backlash portion of the gear of the gear transmission mechanism for driving the sheet feed roller 1. Where a position of a sheet when the rear end of sheet 5 passes between the sheet feed roller and the upstream small roller 3 assumes a position at rear of a predetermined sheet feed pitch, that is, in the vicinity of termination of feed operation, even if the gear transmission mechanism is rotated thereafter through the remaining sheet feed pitch portion, the previous rotation for the backlash portion cannot be absorbed so as to return it to an original positional relation, as a consequence of which there poses a problem in that the sheet feed pitch becomes varied. As a result, print lacks and prints are overlapped, resulting in a problem of extremely lowering a quality of printing. This occurs particularly in case where the thickness of the sheet 5 is large.

SUMMARY OF THE INVENTION

The present invention has been achieved in view of the foregoing. It is an object of the present invention to provide a sheet feed control method which can positively prevent a variation in sheet feed pitch caused by backlash to always obtain a good printing quality.

For achieving the aforesaid object, the present invention provides a sheet feed method in which a sheet is inserted between a sheet feeding cylindrical sheet feed roller and a small roller in pressure contact with the outer peripheral surface of the sheet feed roller, and rotation from a driving source is transmitted to the sheet feed roller through a gear transmission mechanism to rotate the sheet feed roller thereby conveying the sheet to a printing portion and thereafter conveying the sheet through said printing portion with a predetermined feed distance between each line of text to be printed (a predetermined sheet feed pitch), characterized by forecasting a time at which a rear end of the sheet will pass between said sheet feed roller and said small roller, and conveying the sheet a distance other than said predetermined feed distance when said rear end of the sheet passes between said sheet feed roller and said small roller to compensate for and absorb a backlash in a gear of said gear transmission mechanism.

According to the present invention, the sheet feed pitch is adjusted so that when the rear end of the sheet passes through the small roller at upstream, a previous backlash at the time of said passage can be absorbed during the rotation of the gear transmission mechanism through the remaining sheet feed pitch portion after the passage. Therefore, the backlash portion is absorbed, and the variation in the sheet feed pitch can be positively prevented. Accordingly, in printing, it is possible to prevent lacking in print or overlapping in prints, thus always obtaining a good quality of printing.

DETAILED DESCRIPTION OF THE PREFERRED EMBODIMENTS

An embodiment of the present invention will be described hereinafter with reference to FIGS. 1, 2, 3 and 4.

Figure 1:
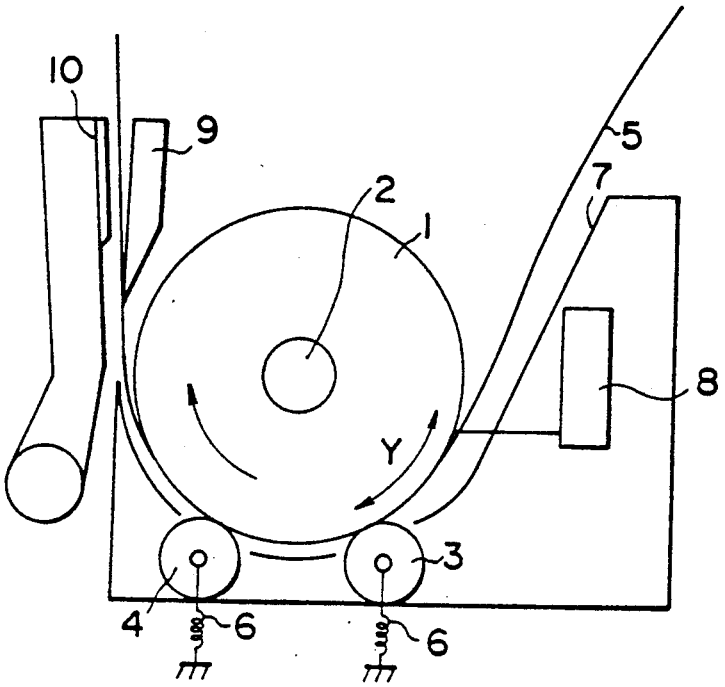
FIG. 1 is a side sectional view showing an embodiment of a thermal printer for carrying out a sheet feed control method according to the present invention.
Figure 2:
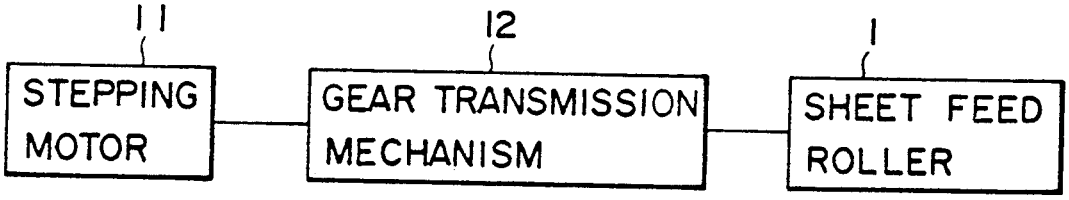
FIG. 2 is an explanatory view showing a power transmission route from a stepping motor to a sheet feed roller in the printer.

FIG. 1 shows one embodiment of a thermal printer for carrying out the sheet feed control method according to the present invention. A center shaft 2 of metal extends through a center of a cylindrical sheet feed roller 1 made of resilient material such as rubber, and a stepping motor M is connected to one end of the center shaft 2 through a gear transmission mechanism 12 in a relation as shown in FIG. 2 whereby when the stepping motor M is driven, the sheet feed roller 1 is rotated a predetermined amount. A small roller 3 at upstream and a small roller 4 at downstream are rotatably disposed below the sheet feed roller 1, and a biasing spring 6 is mounted on each of the small rollers 3 and 4 to bias the small rollers 3 and 4 against the outer peripheral surface of the sheet feed roller 1. A sheet guide 7 for guiding a sheet 5 between the sheet feed roller 1 and each of the small rollers 3 and 4 is disposed below the sheet feed roller 1, and a sheet detection sensor 8 for detecting a rear end of the sheet 5 fed along the sheet guide 7 is disposed on the sheet guide 7. A platen 9 which is in the form of a flat plate and extends vertically as viewed in the paper plane is disposed in the vicinity of the sheet feed roller 1, and frontwardly of the platen 9 is oppositely disposed to be moved to and therefrom a thermal head 10 for applying a desired printing to the sheet 5 fed from the sheet feed roller 1 and the small rollers 3 and 4.

The function of the present embodiment will be described hereinafter.

In the present embodiment, the sheet 5 is inserted between the lower side of the sheet feed roller 1 and the small rollers 3 and 4 along the sheet guide 7. The stepping motor 11 is driven in response to a predetermined drive signal, whereby the sheet feed roller 1 is rotated through a predetermined angle to convey the sheet 5 held between the sheet feed roller 1 and the small rollers 3 and 4 between the platen 9 and the thermal head 10 through a predetermined sheet feed pitch a (for example, a dimension corresponding to a print portion of the thermal head 10). A desired printing is carried out on the sheet 5 by driving the thermal head 10.

Figure 3:
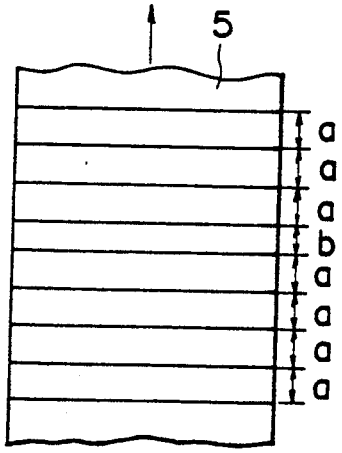
FIG. 3 is an explanatory view showing a sheet feed pitch according to the control method of the present invention.

As shown in FIG. 3, the sheet 5 is conveyed at a predetermined pitch a, and when the rear end of the sheet 5 is detected by the sheet detection sensor 8, the time of passage of the rear end of the sheet 5 between the sheet feed roller 1 and the small roller 3 at upstream from the distance between the position of the sheet detection sensor 8 and the small roller 3 at upstream to forecast it. In the case where the passage time of the rear end of the sheet 5 is positioned at the rear of the predetermined sheet feed pitch a so as not to absorb the previous rotational amount for the previous backlash portion of the gear transmission mechanism, the sheet feed control is made in the following manner. In the sheet feed at the previous stage in which the rear end of the sheet 5 reaches the small roller 3 portion at upstream, adjustment is made so as to reduce the rotational amount of the sheet feed roller 1, and the sheet feed pitch is set to be ($b>a$), after which the sheet is again fed at a predetermined unit sheet feed pitch a. The size of the sheet feed pitch is determined so that when the rear end of the sheet 5 passes through the small roller 3 portion at upstream, the sheet is fed at the pitch a, and the previous rotational amount for the backlash portion enevitally produced at the time of passage can be absorbed during the rotation of the remaining sheet feed pitch of the sheet feed pitch a after the passage. At this time, the energization of the thermal head 10 to the printing portion is adjusted so as to energize the heat generating element corresponding to the minutely controlled sheet feed pitch b. Thereafter, the sheet is thereafter fed at the predetermined sheet feed pitch a. Thereby, when the rear end of the sheet 5 passes between the sheet feed roller 1 and the small roller 3 at upstream, the sheet feed roller 1 is much fed early through the backlash portion by the backlash of the gear transmission mechanism for driving the sheet feed roller 1. However, the position at the predetermined sheet feed pitch a when the rear end of the sheet 5 passes is the position above the sheet feed pitch a. Therefore, the backlash portion becomes absorbed by the time when the sheet 5 is fed to the printing portion of the thermal head 10, and the sheet feed pitch a is not varied.

One specific example of the sheet feed control method will be further described hereinafter. First, let Y be the distance between the sheet detection sensor 8 and the small roller 3. In the sheet feed operation when the rear end of the sheet passes the position of the sheet detection sensor 8, let X be the distance the position at which the rear end of the sheet stops beyond the sheet detection sensor 8 and the sheet detection sensor 8. Let Z be the distance for a portion of rotation caused by the backlash of the gear.

Figure 4:
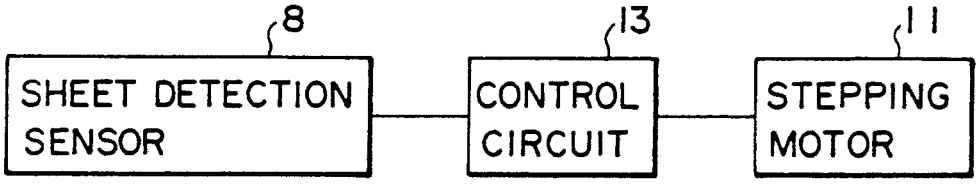
FIG. 4 is a block diagram showing a relationship between a sheet detection sensor and a stepping motor.
Figure 5A:
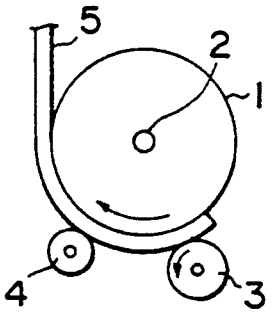
FIG. 5(a) PRIOR ART
FIGS. 5(*a*) and 5(*b*) are respectively schematic illustrations showing a conventional sheet feed mechanism.
Figure 5B:
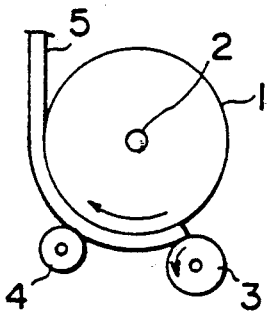
FIG. 5(b) PRIOR ART
Figure 6:
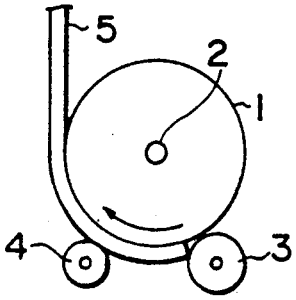
FIG. 6 PRIOR ART
FIG. 6 is an explanatory view showing a varying stae of sheet feed pitch caused by backlash in prior art.

In the sheet feed operation in which the sheet is fed at a constant sheet feed pitch a, at the time the rear end of the sheet stops beyond the sheet detection sensor 8, the following computation is effected within a control circuit 13 on the basis of a signal from the sheet detection sensor 8 as shown in FIG. 4.

$$(Y-X+Z)\approx a$$

Where there is the surplus as the result of the above computation, the sheet feed pitch in the next sheet feed operation is set to the sheet feed pitch b corresponding to the surplus, and a signal corresponding to the aforesaid pitch is sent to the stepping motor 11 to feed the sheet. Thereafter, the sheet feed pitch is set to a to feed the sheet.

As described above, in the present invention, the variation in sheet feed pitch caused by the backlash of the gear of the gear transmission mechanism can be prevented. Therefore, where printing is effected by the thermal head 10, it is possible to positively prevent lacking in print or overlapped print to obtain a good quality of printing.

In the above-described embodiment, the sheet feed control has been made only in the case of the passage of the rear end of the sheet 5 along the small roller portion at upstream. However, where the rear end of the sheet passes the small roller 4 at downstream, the distance between the small roller 4 at downstream and the printing portion of the thermal head 10 is small, and therefore, the variation in sheet feed pitch caused by the backlash occurs but since the variation is beyond the printing range and therefore the printing quality is not affected without adjustment.

It is noted that the present invention is not limited to the above-described embodiment but various modifications can be made as necessary.

As described above, in the sheet feed control method according to the present invention, the sheet feed pitch is adjusted so that when the rear end of the sheet passes in the unit sheet feed pitch, the rotational amount for the previous backlash portion of gear transmission mechanism is absorbed by the rotational amount corresponding to the remaining sheet feed pitch after the passage. Therefore, the backlash portion becomes absorbed by the time when the sheet is fed to the printing portion at the predetermined sheet feed pitch to thereby positively prevent the variation of the sheet feed pitch. Accordingly, it is possible to prevent lacking in print or overlapping in print thus exhibiting an effect in that a good quality of printing can be obtained.

I claim:

1. A sheet feed control method for use in a printing machine that prints a plurality of lines of text in which a sheet is inserted between a sheet feeding cylindrical sheet feed roller and a small roller in pressure contact with the outer peripheral surface of the sheet feed roller, and rotation from a driving source is transmitted to the sheet feed roller through a gear transmission mechanism to rotate the sheet feed roller thereby conveying the sheet to a printing portion and thereafter conveying the sheet through said printing portion with a predetermined feed distance between each line of text to be printed, characterized by forecasting a time at which a rear end of a sheet passes between said sheet feed roller and said small roller, and conveying the sheet a distance other than said predetermined feed distance when said rear end of the sheet passes between said sheet feed roller and said small roller to compensate for a backlash in a gear of said gear transmission mechanism.

2. A sheet feed control method according to claim 1, wherein the sheet is conveyed by said driving source a shorter distance than said predetermined feed distance when said rear end of the sheet passes between said sheet feed roller and said smaller roller.

3. A sheet feed control method according to claim 1, wherein the rear end of the sheet is detected by a sheet detection sensor provided at an upstream location with respect to a sheet feeding direction from said small roller to forecast a time at which the rear end of the sheet will pass between the sheet feed roller and the small roller.

* * * * *